US008245486B2

(12) United States Patent
Wener et al.

(10) Patent No.: US 8,245,486 B2
(45) Date of Patent: Aug. 21, 2012

(54) OBJECT PROTECTION SYSTEM AND METHOD

(75) Inventors: Kenneth Wener, Sparks, NV (US); Ralph T. Bradley, Fallon, NV (US)

(73) Assignee: Appliance Protection Concepts, LLC, Sparks, NV (US)

( * ) Notice: Subject to any disclaimer, the term of this patent is extended or adjusted under 35 U.S.C. 154(b) by 470 days.

(21) Appl. No.: 12/564,660

(22) Filed: Sep. 22, 2009

(65) Prior Publication Data

US 2011/0067802 A1 Mar. 24, 2011

(51) Int. Cl.
*B65B 11/00* (2006.01)

(52) U.S. Cl. ..... 53/397; 53/393; 53/580; 150/165

(58) Field of Classification Search ..... 53/397, 53/393, 580; 150/165, 154
See application file for complete search history.

(56) References Cited

U.S. PATENT DOCUMENTS 6,840,773 B2 * 1/2005 Anderson et al. ..... 434/73
7,332,011 B1 * 2/2008 Sandberg ..... 55/491
7,661,452 B1 * 2/2010 Krioukov et al. ..... 150/165

* cited by examiner

*Primary Examiner* — Thanh Truong
(74) *Attorney, Agent, or Firm* — Woodcock Washburn LLP

(57) ABSTRACT

A protective wrapping system for an object is disclosed that is comprised of a flexible, hardened material for wrapping around the object, a flexible magnetic strip adhered to either end that enables the system to adhere to ferromagnetic materials, and a series of holes that are placed through the material and the magnetic strips to protect it from scrapes and puncture damages when being moved.

13 Claims, 3 Drawing Sheets

OBJECT PROTECTION SYSTEM AND METHOD

BRIEF DESCRIPTION OF THE INVENTION

The present invention is directed to protective wraps and materials for objects, such as appliances, furniture and the like, when being moved, and more particularly to a flexible, hardened material that can be wrapped around the object to protect it from scrapes and puncture damages when being moved.

CROSS-REFERENCES TO RELATED APPLICATIONS

Not applicable.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

When a new appliance, certain furniture and other large objects are delivered to a home or business, they are often wrapped in a thin plastic film to protect them from minor scratches, smudges and dust. These films are so thin that they rarely protect the object at all and are often torn and scratched right through to the object. Because the people moving an object with such a film are under the mistaken impression that such films will protect the object, they are often less careful with the wrapped object than an unwrapped one, resulting in further damage to the object being moved.

To further protect the objects from being damaged by the movers or delivery personnel (i.e., scrapping the object along walls or running into the sharp corners of other objects), the objects are often additionally wrapped in thick insulated moving blankets or furniture pads. A typical moving blanket is 72 inches by 80 inches and is made from a non-woven, polyester fabric covering on both sides, with a cotton filler. The blanket is often quilted to keep the cotton filler from bunching up within the blanket. The more expensive the blanket, the thicker the blanket. More expensive blankets are often made entirely of cotton and can be washed. A furniture pad is often smaller than a blanket and thicker. Additional moving materials include quilted and padded covers for certain types of appliances and furniture, such as refrigerator covers and couch covers that come in different sizes and fit snuggly over the top and sides of the object to be moved.

To keep a rectangular padded cover (versus a fitted cover) in place, packing tape, bungee cords or large rubber bands are wrapped around the blankets and object. Using packing tape is wasteful and expensive and leaves adhesive material on the blankets as well as the object being moved when the blankets are reused without cleaning. Bungee cords and rubber bands can be awkward to use and add additional girth to the object being moved. The additional girth is a non-trivial issue. As appliances get larger and larger, they get harder to move into certain buildings, especially older buildings that have narrower doorways, elevators and hallways. Once an object has been wrapped on all sides and secured in place with bungee cords and/or bands, an inch or more can be added to the overall width of the object being moved. When this object is being moved through a doorway that requires the door to be removed or other tight areas, there is an even greater likelihood that the object being moved will come in contact with another object, such as a door jamb, a corner of a wall, etc.

Finally, although moving blankets and similar types of blankets are soft and thick, and will protect an object from being lightly scrapped, such blankets do not provide protection from harder scrapes (where the object coming in contact with the object being moved asserts significant pressure against the object being moved) and/or punctures from sharp objects.

DETAILED DESCRIPTION OF THE INVENTION

Figure 1:
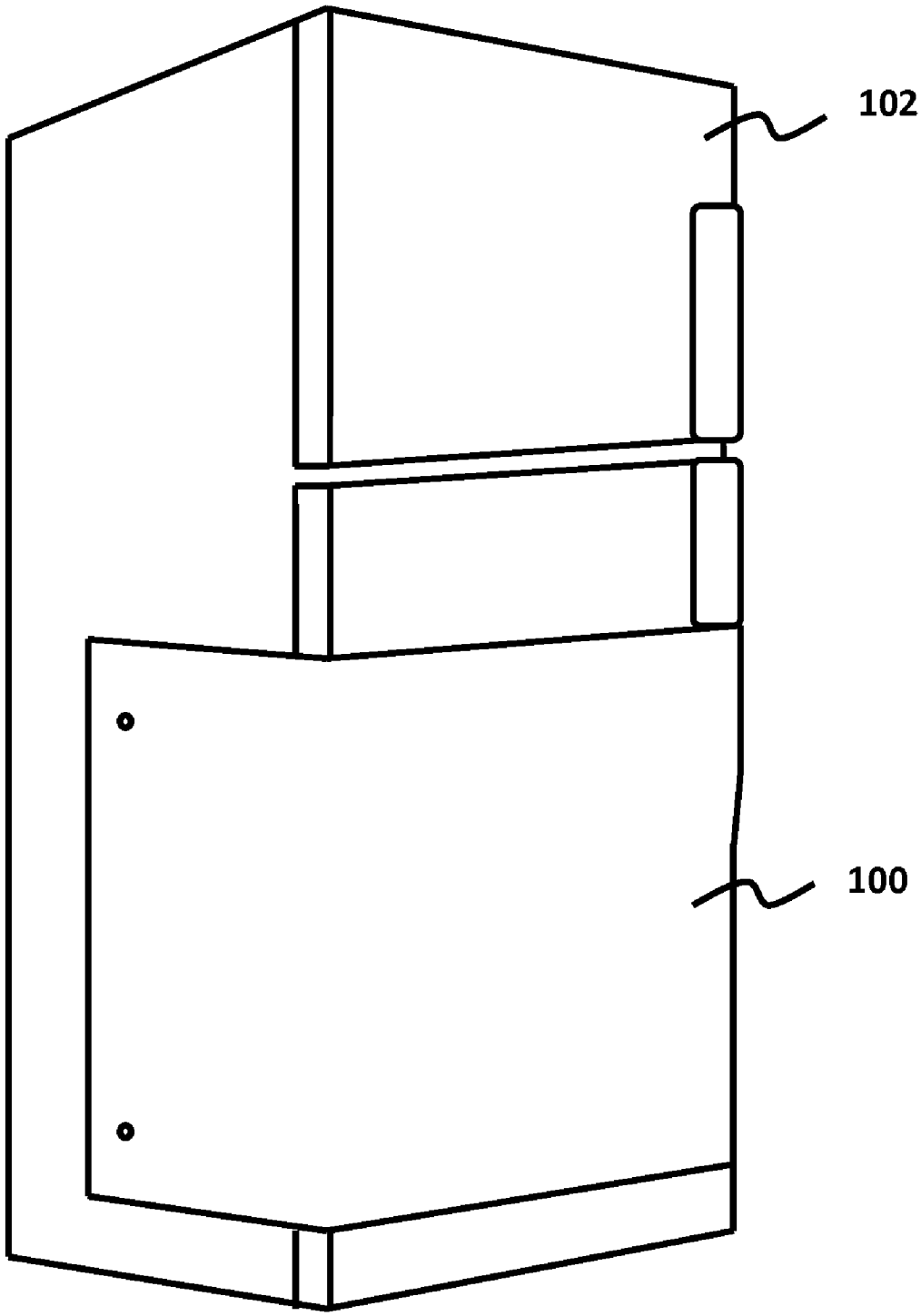
FIG. 1 is a perspective view of an object partially wrapped with the protection system of the present invention.

The present invention is related to an improved form of a temporary protective wrapping for objects, such as appliances, furniture and the like, when being moved. As illustrated in FIG. 1, the object protection system is comprised of a flexible material and system 100 that can be wrapped around the object, such as the refrigerator 102, to be moved while protecting it from harder, pressure-backed scrapes and many punctures. In its preferred embodiment, the object protection system is formed of a vinyl material having a thickness of approximately 40 mil, which is equivalent to approximately 1 mm, although other materials of sufficient flexibility and hardness could also be utilized, ranging in thickness from approximately 20 mil to approximately 80 mil. The vinyl material can be smooth or have a textured surface, although a textured surface is preferred because it helps to prevent sand, dust and other dirt from sticking to the material. Since the material, at least on one side, is placed in contact with the object to be moved, if the material has collected any type of gritty material on that face, it may scratch the surface of the object, which is not desirable and defeats the purpose of protecting the object from being scratched.

The thickness of the material is an important feature of the present invention. The material is significantly thicker than the thin plastic materials covering new appliances, which do little to nothing to protect those objects, but must be thinner than the moving blankets and similar materials the present invention is intended to replace. Testing of the present material indicates that if the material was significantly thinner than approximately 40 mil, it would not adequately protect the object, but if it was significantly thicker than approximately 40 mil, it would add too much girth to the object being moved (in the same manner as moving blankets) and become an obstruction as the object is moved through tight areas, such as doorways.

The vinyl material also needs to exhibit both scratch hardness, which is a measure of its resistance to permanent deformation due to friction, as well as indentation hardness, which is a measure of its resistance to permanent deformation due to an impact from a sharp object. The preferable hardness of the material is a Shore durometer measurement of 85 on the A scale (referred to herein as "85 Shore A"). At the same time, the material cannot be so hard that it is inflexible. As shown in FIG. 1, the material must be able to bend around a ninety degree angle without cracking or otherwise deforming. Hence, the material must be able to absorb or deflect scratches and indentations as much as possible without passing on those scratches and indentations to the object being moved. Finding the right balance between sufficiently hard and sufficiently flexible material was difficult, but met by the material utilized in the present invention so as to avoid damage to the object being moved the majority of the time. A commercially available flexible composite polymer material having a texture similar to the hair cell or calf grain textures produced by Walton Plastics of Walton Hills, Ohio is presently preferred.

Figure 2:
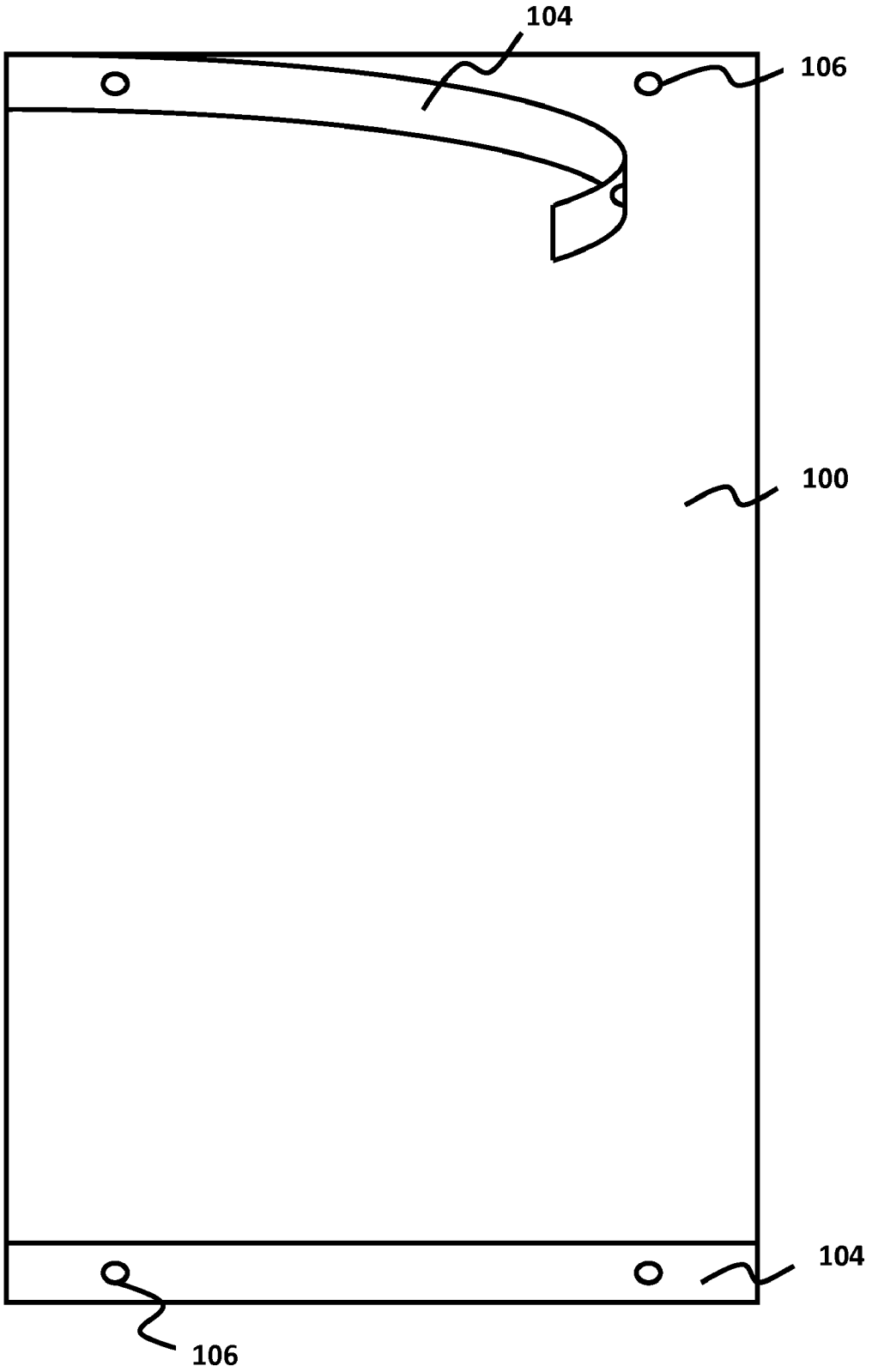
FIG. 2 is a perspective view of the protection system of FIG. 1, further illustrating the flexible magnetic strips of the present invention.

To further reduce the girth of the material when possible, as further illustrated in FIGS. 1 and 2, the flexible material and system 100 includes two flexible magnetic strips 104 affixed to each end of one side of the system 100. FIG. 1 shows the system 100 wrapped around the refrigerator 102 with the magnetic strips 104 of the system 100 facing against the refrigerator 102. When the refrigerator 102 has sides made of ferromagnetic material, the magnetic strips 104 will be attracted to the side and will be held in place against the refrigerator. FIG. 2 illustrates the opposite side of the system 100 shown in FIG. 1, showing the magnetic strips 104, with one magnetic strip 104 partially pulled away from the vinyl material to demonstrate its flexibility. The magnetic strips are made of thermoplastic, flexible material produced by Magnum Magnetics of Marietta, Ohio. The magnetic strips are adhered to the vinyl material by 3M RITE-LOK SF100 Super Fast Cyanoacrylate adhesive.

In the event the exterior of the object wrapped by the system 100 is not made of a ferromagnetic material, such as stainless steel, aluminum and other materials, the system 100 also includes four holes 106 to which bungee type cords or other securing materials, such as elastic bands, nylon string, rope, etc., can be hooked or tied to in order to hold the system 100 in place. For example, as illustrated in FIG. 1, if the refrigerator 100 did not have magnetic sides, a bungee cord hook could be placed in one of the holes 106 and secured by the remaining material of the vinyl material and the magnet, then the elastic materials of the cord could be stretched around the refrigerator until the hook on the other end of the bungee cord could be secured to a hole 106 on the opposite end of the system 100. As noted above, in order to make the system 100 more resistant to tearing when securing materials where fastened to the system by means of the holes 106, the magnetic material also includes holes that match up with corresponding holes in the vinyl material. The combined strength of the two materials (the vinyl and the magnetic strips) makes the system much less likely to tear.

Figure 3:
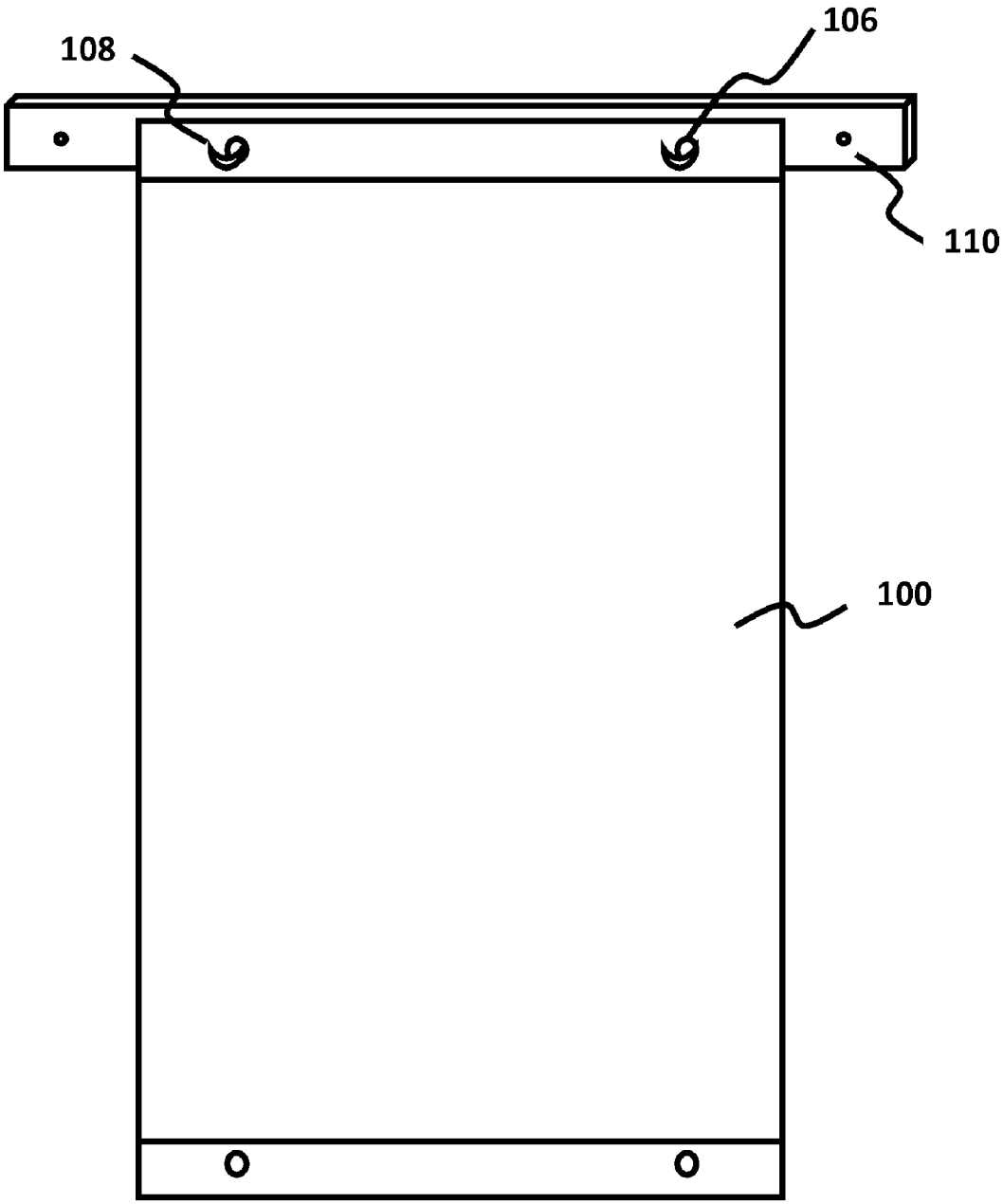
FIG. 3 is a perspective view of the protection system of FIGS. 1 and 2 when stored within a moving vehicle.

In addition to the purpose noted above, the holes 106 also serve another valuable purpose, as illustrated in FIG. 3. As previously noted, it is important to keep dirt and other debris from collecting on the system 100, so as to further protect the object being wrapped. This is also the case with other forms of protective wrapping systems, such as moving blankets, but despite this fact, they are often placed or thrown on the bed of the trucks used to deliver the objects. As a result, they pick up dust and debris, which then ends up being placed against the object being moved. By attaching hooks 108 to the inside walls of a truck, building or other workplace, or to a hanger 110 attached to the inside walls of the truck, building, etc., the holes 106 of each system can be placed over the hooks and raised up off the bed of the truck or the floor of the building. This also allows more of the systems 100 to be stored within the truck or building without taking up valuable floor space. Finally, when the systems 100 are stored in a truck when not in use and the truck is moving about, the movement of the truck and the frictional effect of each system 100 rubbing against one another will help to knock off any debris or dust that might have collected on the systems 100.

Although the vinyl material of the system 100 could be any color, applicant has found a bright yellow color to be more effective at causing users of the system to be more cautious moving the object about which the system 100 is wrapped, which serves to further enhance the protective features of the present invention.

While the present invention has been illustrated and described herein in terms of a preferred embodiment and several alternatives, it is to be understood that the techniques described herein can have a multitude of additional uses and applications. Accordingly, the invention should not be limited to just the particular description and various drawing figures contained in this specification that merely illustrate a preferred embodiment and application of the principles of the invention.

What is claimed is:

1. An object protection system, comprising:

a sheet of material for wrapping at least part way around an object, the sheet of material having a thickness of between approximately 20 mil and 80 mil and having sufficient flexibility to bend repeatedly at a ninety degree angle around the object without causing damage to the sheet of material, the sheet of material forming at least a first set of holes at a first end of the sheet of material and at least a second set of holes at a second end of the sheet of material, the first end being opposite to the second end;

a first flexible strip of magnetic material adhered to the first end, the first flexible strip of magnetic material forming at least a third set of holes that align with the first set of holes; and a second flexible strip of magnetic material adhered to the second end, the second flexible strip of magnetic material forming at least a fourth set of holes that align with the second set of holes, the first set of holes, the second set of holes, the third set of holes, and the fourth set of holes being sufficiently sized to receive a hook from a securing material or a hanger.

2. The object protection system of claim 1, wherein the sheet of material has a hardness of at least Shore 85 A durometer.

3. The object protection system of claim 2, wherein the sheet of material is made of a flexible composite polymer material.

4. The object protection system of claim 3, wherein the sheet of material is textured on at least one side.

5. The object protection system of claim 4, wherein the sheet of material is a bright yellow color that induces a user to employ caution with the object.

6. The object protection system of claim 1, wherein the sheet of material is made of a flexible composite polymer material.

7. The object protection system of claim 6, wherein the sheet of material is textured on at least one side.

8. The object protection system of claim 7, wherein the sheet of material is a bright yellow color that induces a user to employ caution with the object.

9. The object protection system of claim 1, wherein the sheet of material is textured on at least one side.

10. The object protection system of claim 9, wherein the sheet of material is a bright yellow color that induces a user to employ caution with the object.

11. The object protection system of claim 1, wherein the sheet of material is a bright yellow color that induces a user to employ caution with the object.

12. A method for protecting an object being moved, comprising the steps of:

placing a sheet of material having a first flexible strip of magnetic material adhered to a first end of the sheet of material and a second flexible strip of magnetic material adhered to a second end of the sheet of material at least part way around the object, the sheet of material having a thickness of between approximately 20 mil and 80 mil and having sufficient flexibility to bend repeatedly at a ninety degree angle around the object without causing damage to the sheet of material, the sheet of material forming at least a first set of holes at the first end and at least a second set of holes at the second end, the first end being opposite to the second end, the first flexible strip of magnetic material forming at least a third set of holes that align with the first set of holes, and the second flexible strip of magnetic material forming at least a fourth set of holes that align with the second set of holes; and attaching a first end of a securing material to at least one of the first set of holes and at least one of the third set of holes and a second end of the securing material to at least one of the second set of holes and at least one of the third set of holes, if the first flexible strip of magnetic material and the second flexible strip of magnetic material will not magnetically adhere to the object.

13. The method for protecting an object being moved as recited in claim 12, further comprising the step of hanging the sheet of material from at least the first set of holes and the third set of holes from a hanger so as to prevent debris from collecting on the sheet of material prior to being placed around the object.

* * * * *